United States Patent [19]

Santalla

[11] 4,419,941

[45] Dec. 13, 1983

[54] SUPPLYING PULVERIZED COAL TO A COAL-FIRED FURNACE

[75] Inventor: Richard W. Santalla, Enfield, Conn.

[73] Assignee: Combustion Engineering, Inc., Windsor, Conn.

[21] Appl. No.: 437,428

[22] PCT Filed: Sep. 2, 1982

[86] PCT No.: PCT/US82/01193

§ 371 Date: Oct. 13, 1982

§ 102(e) Date: Oct. 13, 1982

[51] Int. Cl.[3] ..... F23K 1/00

[52] U.S. Cl. ..... 110/232; 110/264; 110/347; 110/101 CF; 110/106

[58] Field of Search ..... 110/232, 347, 263, 264, 110/101 CF, 106

[56] References Cited

U.S. PATENT DOCUMENTS

| | | | |
|---|---|---|---|
| 3,229,651 | 1/1966 | Wasp | 110/347 |
| 3,267,891 | 8/1966 | Hemker | 110/232 |
| 4,173,189 | 11/1979 | Cooper | 110/106 |
| 4,182,245 | 1/1980 | Stewart et al. | 110/101 CF |
| 4,236,886 | 12/1980 | Ansen et al. | 110/347 X |
| 4,249,470 | 2/1981 | Vatsky | 110/232 |
| 4,250,816 | 2/1981 | Angevine et al. | 110/101 CF |
| 4,259,911 | 4/1981 | Jones | 110/245 |
| 4,263,856 | 4/1981 | Rickard | 110/347 |
| 4,310,299 | 1/1982 | Binasik et al. | 110/347 X |
| 4,332,207 | 6/1982 | Blaskowski et al. | 110/347 |
| 4,373,451 | 2/1983 | Gardner et al. | 110/347 X |

FOREIGN PATENT DOCUMENTS

| | | | |
|---|---|---|---|
| 154503 | 3/1982 | Fed. Rep. of Germany | 110/232 |
| 56-149517 | 11/1981 | Japan | 110/232 |

*Primary Examiner*—Edward G. Favors

*Attorney, Agent, or Firm*—William W. Habelt

[57] ABSTRACT

A direct-fired, pulverized coal-fired furnace 2, wherein the fuel supply system is modified so that a load carrying pulverizer 10 supplying pulverized coal to the furnace through a plurality of burners 4 may simultaneously also supply pulverized coal to a storage bin 16 for storage therein until needed to start-up, warm-up and stabilize the low load firing of the furnace 2 at a later time.

3 Claims, 1 Drawing Figure

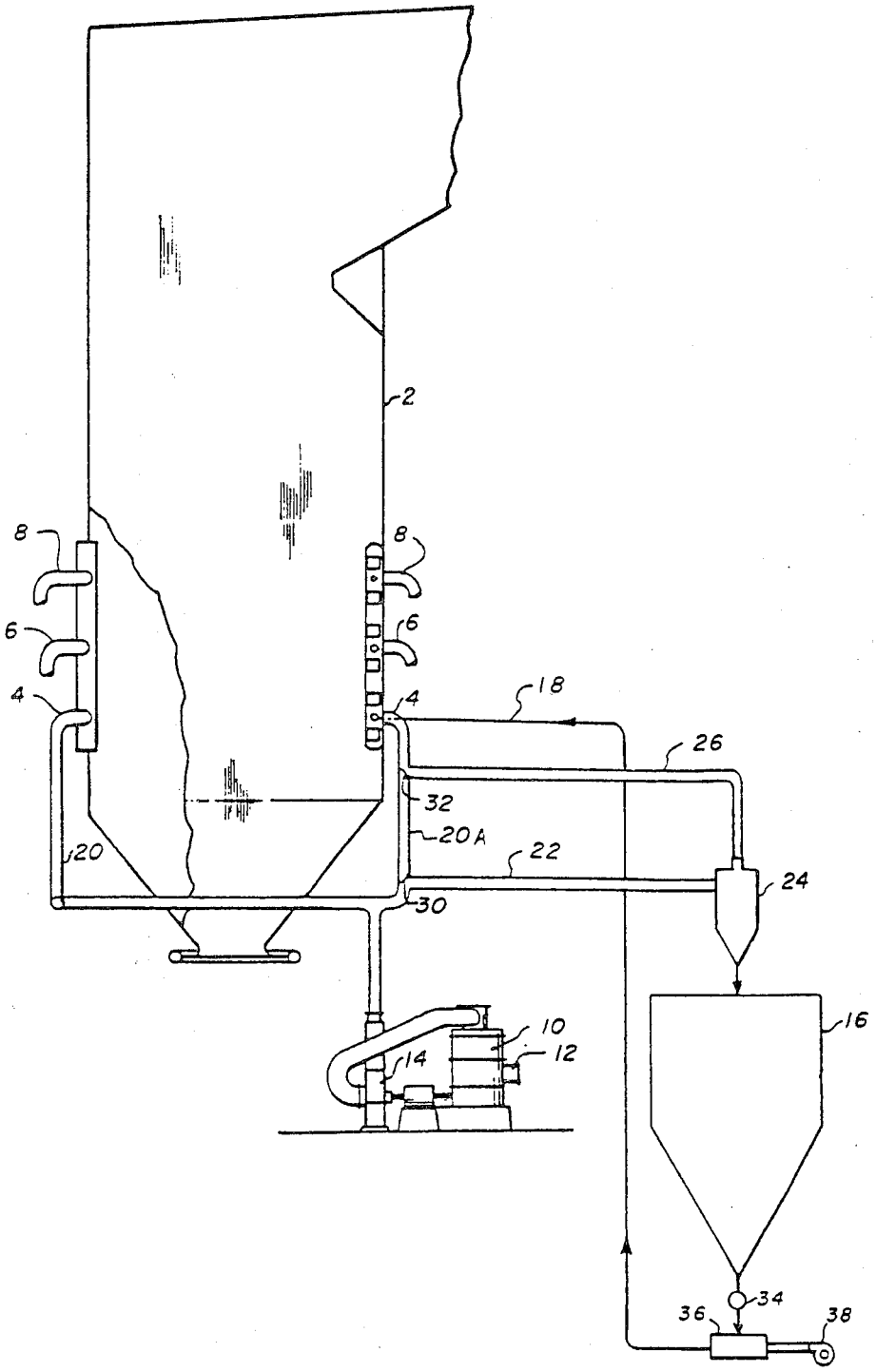
2
8
8
6
6
4
4
18
26
32
20A
22
20
24
30
10
12
14
16
34
36
38

SUPPLYING PULVERIZED COAL TO A COAL-FIRED FURNACE

BACKGROUND OF THE INVENTION

The present invention relates to the field of coal-fired furnaces, and more particularly, to pulverized coal-fired furnaces designed as direct-fired systems. Specifically, this invention is directed to an apparatus for supplying pulverized coal simultaneously to the direct-fired furnace and to a storage bin from one pulverizer.

In order to avoid the high cost of oil and gas, electric utilities have increasingly chosen coal as the fuel to fire the furnaces of their steam generating boilers. However, even in coal-fired furnaces, substantial quantities of oil and gas are often used. In a typical coal fired unit, the coal must be dried and pulverized in a pulverizer by heated air before it can be burned in the furnace. The heated air used to dry the coal is supplied by a forced-draft fan that forces the air through a preheater wherein the air is passed in heat exchange with hot combustion products leaving the furnace.

Therefore, it is necessary that the furnace be already operating in order to dry the coal for the coal to be burned in the furnace. Accordingly, in a typical pulverized coal-fired furnace, a relatively large capacity oil burner is started by an ignitor and operated for a fairly long period of time to warm up the furance walls and the heat exchange surfaces of the air preheater. Once the furnace has been brought up to temperature, the pulverized coal is supplied to the furnace and ignited by oil or gas ignitors associated with the coal burners.

It has been determined that the use of auxiliary fuels such as oil or gas can be minimized by warming the furnace up on pulverized coal which has been pulverized and dried previously when the furnace was in operation and stored in the interim in a storage bin. When it is necessary to warm the furnace up, the pulverized coal is fed to the furnace from the storage bin, typically in a dense phase stream, and ignited in the furnace by a small oil or gas ignitor. Additionally, it has even been suggested that the oil and gas ignitors can be eliminated by using a coal-fired ignitor supplied with pulverized coal from storage bin lit off by the use of an electric spark plug. U.S. Pat. No. 4,173,189 discloses one method and apparatus for using pulverized coal in ignitor burners for the cold start-up, warm-up, and low load stabilization of a pulverized coal-fired furnace wherein the pulverized coal for start-up and warm-up is supplied from a storage bin.

Additionally, it has been proposed that pulverized coal from a storge bin be used in conjunction with a direct-fired furnace in order to increase load capacity on the furnace. One method for utilizing supplemental pulverized coal from a storage bin for increasing load capacity is disclosed in U.S. Pat. No. 4,263,856. Therein, it is disclosed that pulverized coal from the storage bin may be conveyed as a dense phase mixture of pulverized coal and air having a air to coal rate ratio below approximately 1.0 and injected into the main pulverized coal stream being supplied from the pulverizers in order to increase the capacity of the pulverizers.

In either of these systems for utilizing pulverized coal from a storage bin, it is customary to supply pulverized coal to the storage bin from either a pulverizer set aside only for that purpose or from one of the load carrying pulverizers of the direct-fired furnace when that pulverizer is not needed to carry load on the furnace. However, there are times when it will be desirable to use a load carrying pulverizer of the direct-fired furnace simultaneously for both maintaining load on the furnace and supplying pulverized coal to the storage bin.

SUMMARY OF THE INVENTION

It is accordingly an object of the present invention to simultaneously supply pulverized coal from a load carrying pulverizer directly to the pulverized coal-fired furnace and also to a storage bin for use at a later time.

Accordingly, in a pulverized coal-fired steam generator having a direct-fired furnace, at least two burners for burning pulverized coal in the furnace, a load-carrying pulverizer for pulverizing the coal to be supplied to the furnace, and a plurality of conduits, one conduit per burner, interconnected between the burners and the pulverizer, each conduit for conveying a coal/air stream consisting essentially of a dilute phase pulverized coal and air mixture from the pulverizer to its associated burner, a diversion conduit is provided for diverting the dilute phase mixture of pulverized coal and air passing through one of the conduits to a coal-air separator for separating the pulverized coal and air. Valve means are disposed at the intersection of the diversion conduit with the conduit from which the pulverized coal is diverted for selectively diverting the coal and air stream flowing therethrough into the diversion conduit. A return conduit interconnects the separator with the conduit from which the coal was diverted at a location downstream of the valve means. The return conduit provides a means for venting the air removed from the coal and air stream in the separator back to the furnace. Means are provided for conveying the pulverized coal removed from the coal and air stream in the separator to a storage bin.

BRIEF DESCRIPTION OF THE DRAWING

The present invention may be better understood and unique features and advantages of the invention become more evident by reference to the accompanying drawing wherein there is depicted a diagrammatic representation of a system for supplying pulverized coal from a load carrying pulverizer simultaneously to the pulverized coal-fired furnace and to a pulverized coal storage bin for storage until the pulverized coal is needed to start-up and warm-up the furnace.

DETAILED DESCRIPTION OF THE PREFERRED EMBODIMENT

Referring now to the drawing, there is depicted therein a furnace 2 having a plurality of burners or coal nozzles 4, 6 and 8 disposed in vertically spaced rows with four burners in each row, that is, with one burner per row mounted in each of the four corners of the furnace and aimed tangential to an imaginary circle in the center of the furnace so as to form a rotating vortex flame in accordance with the well known tangential firing method. To fire the furnace, raw coal is delivered to the furnace pulverizer 10 wherein the coal is ground to pulverized coal and dried by hot air, termed primary air, drawn from the air preheater through hot air supply duct 12. The pulverized coal is entrained in the hot air to form a dilute phased coal/air stream and is drawn from the pulverizer 10 by exhauster 16 and conveyed through the main fuel pipe 20 to the burners 4 for combustion in the furnace 2. Typically, a single pulverizer 10 will serve all four burners disposed at a single elevation in the four corners of the furnace. Additionally, additional pulverizers are typically provided to supply coal to each additional elevation of burners, although it is not uncommon for a single pulverizer to supply all the burners in two neighboring rows. Therefore, a single pulverizer will generally serve a plurality of burners ranging from at least 2 to 8 or more.

Pulverized coal may also be supplied to the furnace 2 independently of the load carrying pulverizer 10 from a storage bin 16 in a dense phase pulverized coal/air stream 18. To establish the dense phase stream 18, pulverized coal is fed from storage bin 16 through the rotary feeder 34 into mixing means 36. Dense phase mixer 36, which may be either a pulverized coal transport pump or simply a venturi pick-up device, mixes the pulverized coal received from the storage bin 16 with compressed air from a compressed air upply means 38 so as to establish a pulverized coal and air stream consisting essentially of a mixture of pulverized coal and air having an air-to-coal weight ratio below 1.0 The dilute phase pulverized coal and air mixture supplied by the pulverizer 10 to the furnace 4 has an air-to-coal weight ratio somewhat above 1.0, typically in the range of 1.5 to 2.0.

As mentioned previously, the dense phase pulverized coal stream 18 from the storage bin 16 may be used to start-up, warm-up, and stabilize the operation of the pulverized coal-fired furnace 2 at low load in accordance with the teachings of U.S. Pat. No. 4,173,189 or the dense phase pulverized coal stream 18 from storage bin 16 may be used to provide increased load capacity on the furnace 2 as disclosed in U.S. Pat. No. 4,252,069. Additionally, although the dense phase pulverized coal stream 18 is shown as being injected into the furnace through the burner 4, it is also possible to supply the dense phase stream 18 to its own burner, not shown, which would typically be disposed between the rows of burners 4 and 6.

Typically, in prior art storage systems the pulverized coal would be supplied to the pulverized coal storage bin 16 through a separate storage system pulverizer. Alternatively, pulverized coal has been supplied to the pulverized coal storage bin in the past from a load carrying pulverizer but only when that load carrying pulverizer was not needed to maintain load on the furnace such as during the night when the furnace is typically operated at low loads due to decreased electrical demand.

In accordance with the present invention, there is provided a system whereby pulverized coal may be supplied from a single load carrying pulverizer simultaneously to both the pulverized coal-fired steam generator and the pulverized coal storage bin. In the preferred embodiment, as shown in the drawing, pulverized coal is diverted from conduit 20A interconnecting the pulverizer 10 with one of the burners 4 through a diversion duct 22 to a separator 24 wherein the pulverized coal is separated from the dilute phase pulverized coal and air mixture. The function of the separator 22 is to separate out the air, or other carrying fluid such as a mixture of air and flue gas, that has entrained the coal in the pulverizer 10. The air separated from the coal in the separator 24 leaves separator 24 through return conduit 26 which reconnects the separator with the conduit 20A from which the pulverized coal mixture was diverted at a location downstream of valve means 30. The separated air then traverses conduit 20A to the burner 4 and is vented into the furnace so that any coal dust carried over from the separator 24 will be incinerated.

Valve means 30 disposed at the interconnection of the diversion duct 22 with the conduit 20A serves to selectively divert the dilute phase pulverized coal/air stream flowing through conduit 20A into the diversion duct 22 whenever it is desired to supply pulverized coal to the storage bin 16. When it is desired to supply all the coal pulverized in pulverizer 10 to the furnace 2 through the burners 4, valve 30 is actuated so as to close against the opening of the conduit 22 into the conduit 20A thereby prohibiting the flow of any coal through the diversion conduit 22. Conversely, when it is desired to supply coal to the pulverized storage bin 16, the valve 30 is actuated to close off conduit 20A at a point adjacent the intersection of the diversion conduit 22 with the conduit 20A so as to cause the pulverized coal and air mixture entering conduit 20A to be diverted through diversion conduit 22 to the separator 24. At the same time, pulverized coal will still be supplied from the pulverizer 10 to the furnace 2 through the remaining conduits 20 as during normal operation.

Additionally, a second valve means 32 may be disposed at the intersection of the return conduit 26 and the main conduit 20A for closing off the opening to the return conduit 26 when the pulverized coal storage bin is not being filled so as to prevent the back flow of pulverized coal and air passing through the conduit 20A from flowing into the return conduit 26. Although both the main valve means 30 and the second valve means 32 are shown in the drawing as flapper valves, it is to be understood that any of a number of known valve means suitable for handling a mixture of pulverized coal and air may be utilized for this purpose.

In the preferred embodiment of the present invention, the conduit 20A of the plurality of the conduits interconnecting the pulverizer 10 with the burners 4 is the shortest conduit of that plurality. In a typical tangential furnace of the type shown in the drawing, the fuel conduit which supplies the burner 4 in the corner of the furnace 2 farthest from the pulverizer 10 is about twice the length of the conduit 20A supplying the burner 4 in the corner of the furnace 2 closest to the pulverizer 10. Therefore the pressure drop experienced by the pulverized coal and air mixtures traveling through the conduits 20 would vary depending upon the length of pipe. However, it is customary to balance the pressure drop through the various conduits 20 in order to insure that each burner receives approximately the same flow quantity of pulverized coal and air by placing orifices within the fuel conduits 20 so as to balance out the pressure drop. If the shortest conduit 20A is used to supply the pulverized coal storage bin 16, it is likely that the pressure drop provided by the diversion conduit 22, the separator 24 and the return conduit 26 will serve to balance out the pressure drop of the conduit 20A with the longest of the fuel conduits 20 when pulverized coal is being supplied to the storage bin 16. In order to balance the pressure drop when the pulverizer is used solely to supply pulverized coal to all four burners 4, the customary orifice may be disposed in the section of conduit 20A located between the intersection of the diversion conduit 22 with the conduit 20A and the return conduit 26 with the conduit 20A thereby providing the necessary pressure drop to balance off the pressure drop with the remaining fuel pipes 20.

While the present invention has been described and illustrated herein in relation to a tangential furnace, it is to be understood that the present invention may apply to any direct-fired pulverized coal-fired furnace wherein a load carrying pulverizer supplies pulverized coal and air to at least two burners of the furnace whether they be mounted in the walls of the furnace or in the corners as in the tangential firing method. Further, it is to be understood that the specific embodiment shown in the drawing is merely illustrative of the best mode presently contemplated by the applicant for carrying out the invention and is by no means meant as a limitation. Accordingly, it is intended that any modification which is apparent to those skilled in the art in light of the foregoing description and which falls within the spirit and scope of the appended claims be included in the invention as recited in the appended claims.

I claim:

1. In a pulverized coal-fired steam generator having a direct-fired furnace, at least two burners for burning pulverized coal in the furnace, a load-carrying pulverizer for pulverizing the coal to be supplied to the furnace, and a plurality of conduits, one conduit per burner, interconnected between the burners and the pulverizer, each conduit conveying a coal/air stream consisting essentially of a dilute phase pulverized coal and air mixture from the pulverizer to its associated burner, an apparatus comprising:

a. a separator for separating pulverized coal from air;

b. a diversion conduit interconnected between the separator and a first of the plurality of conduits interconnected between the burners and the pulverizer;

c. valve means disposed at the interconnection of said diversion conduit with the first of the plurality of conduits for selectively diverting the coal/air stream flowing therethrough into said diversion conduit;

d. a return conduit interconnecting said separator with the first of the plurality of conduits at a location downstream of said valve means for venting the air removed from the coal/air stream in said stream in said separator to the furnace;

e. a storage bin; and f. means for conveying the pulverized coal removed from the coal/air stream in said separator to the storage bin.

2. An apparatus as recited in claim 1 further comprising means for conveying the pulverized coal from said storage bin to the furnace comprising:

a. mixing means for establishing a dense phase mixture of pulverized coal and air;

b. means for feeding pulverized coal from said storage bin to said mixing means; and c. means for conveying said dense phase mixture of pulverized coal entrained in air from said mixing means to the furnace.

3. An apparatus as recited in claims 1 or 2 wherein the first conduit from which the pulverized coal and air stream is diverted to the separator is the shortest conduit of the plurality of conduits interconnected between the burners and the pulverizer.

* * * * *